US009325134B2

(12) United States Patent
Lopez et al.

(10) Patent No.: US 9,325,134 B2
(45) Date of Patent: Apr. 26, 2016

(54) PIVOT CONNECTOR, POWER INPUT ASSEMBLY, ELECTRICAL CONNECTOR APPARATUS, AND METHOD OF PIVOTING ELECTRICALLY CONNECTING APPARATUS

(71) Applicant: CREE, INC., Durham, NC (US)

(72) Inventors: Peter E. Lopez, Cary, NC (US); James Michael Lay, Apex, NC (US)

(73) Assignee: Cree, Inc., Durham, NC (US)

( * ) Notice: Subject to any disclaimer, the term of this patent is extended or adjusted under 35 U.S.C. 154(b) by 439 days.

(21) Appl. No.: 13/621,475

(22) Filed: Sep. 17, 2012

(65) Prior Publication Data

US 2013/0337662 A1 Dec. 19, 2013

Related U.S. Application Data

(60) Provisional application No. 61/660,320, filed on Jun. 15, 2012.

(51) Int. Cl.

| | |
|---|---|
| ***H01R 35/00*** | (2006.01) |
| ***H01R 13/58*** | (2006.01) |
| ***F21V 23/06*** | (2006.01) |
| *F21S 8/02* | (2006.01) |
| *F21Y 101/02* | (2006.01) |
| *F21V 29/77* | (2015.01) |

(52) U.S. Cl.

CPC ..... *H01R 35/00* (2013.01); *F21V 23/06* (2013.01); *H01R 13/5841* (2013.01); *F21S 8/026* (2013.01); *F21V 29/773* (2015.01); *F21Y 2101/02* (2013.01)

(58) Field of Classification Search

CPC ..... H01R 35/04; H01R 33/94

USPC ..... 439/611

See application file for complete search history.

(56) References Cited

U.S. PATENT DOCUMENTS

| | | | | | |
|---|---|---|---|---|---|
| 2,231,565 | A | * | 2/1941 | De Reamer et al. | 439/8 |
| 2,740,039 | A | * | 3/1956 | Phillips | 439/10 |
| 3,043,611 | A | * | 7/1962 | Barrett | 439/11 |
| 3,679,236 | A | * | 7/1972 | Warshawsky | 285/39 |
| 3,837,607 | A | * | 9/1974 | Hesse | 248/278.1 |
| RE31,537 | E | * | 3/1984 | Flatland | 433/82 |
| 4,959,021 | A | * | 9/1990 | Byrne | 439/310 |
| 4,997,381 | A | * | 3/1991 | Oh | 439/172 |
| 5,658,152 | A | * | 8/1997 | Selker | 439/31 |
| 5,711,674 | A | * | 1/1998 | Chu | H01R 33/94 439/11 |
| 5,735,707 | A | * | 4/1998 | O'Groske et al. | 439/446 |

(Continued)

OTHER PUBLICATIONS

U.S. Appl. No. 13/461,248, filed May 1, 2012, Lopez.

*Primary Examiner* — Briggitte R Hammond
(74) *Attorney, Agent, or Firm* — Burr & Brown, PLLC

(57) ABSTRACT

A pivot connector comprising a body element and a retention element that comprises a body element interface structure (comprising at least a first pivot alignment structure), the body element comprising a retention element interface region that comprises a pivot alignment structure-receiving region. A power input assembly comprising a pivot connector, an electrical connector region and an electrical conductor that extends through an internal space defined by the retention element and that is electrically connected to the electrical connector region. An electrical connector apparatus comprising a power input assembly, a second electrical connector region and a power input assembly engagement region. A method comprising pivoting a retention element relative to a body element.

32 Claims, 5 Drawing Sheets

(56) References Cited

U.S. PATENT DOCUMENTS 6,152,639 A * 11/2000 Hsu ..... 403/116
6,695,620 B1 * 2/2004 Huang ..... 439/11
7,066,753 B1 * 6/2006 Tseng ..... 439/259
7,614,902 B2 * 11/2009 Bayat et al. ..... 439/446
7,887,331 B1 * 2/2011 Lin ..... H01R 33/94 439/8

* cited by examiner

PIVOT CONNECTOR, POWER INPUT ASSEMBLY, ELECTRICAL CONNECTOR APPARATUS, AND METHOD OF PIVOTING ELECTRICALLY CONNECTING APPARATUS

CROSS-REFERENCE TO RELATED APPLICATIONS

This application claims the benefit of U.S. Provisional Patent Application No. 61/660,320, filed Jun. 15, 2012, the entirety of which is incorporated herein by reference as if set forth in its entirety.

FIELD OF THE INVENTIVE SUBJECT MATTER

The present inventive subject matter relates to apparatus that provides (or assists in providing) mechanical and/or electrical connection between two or more components. In some aspects, the present inventive subject matter relates to apparatus that provides (or assists in providing) electrical connection between a power input assembly (e.g., which may comprise one or more conductors of electricity) and a lighting device (e.g., which may comprise one or more light emitters that are illuminated by having electricity supplied to them). In some aspects, the present inventive subject matter relates to apparatus that provides (or assists in providing) pivoting mechanical connection between two or more components that are being electrically connected. The present inventive subject matter also relates to methods of providing electrical connection between two or more components, e.g., between a power input assembly and a lighting device, and/or that provides pivoting mechanical connection between such components.

BACKGROUND

There is an ongoing need for electrical connector apparatus (and methods of electrically connecting apparatus), that provide reliable electrical connection. There is also an ongoing need for electrical connector apparatus (and methods of electrically connecting apparatus), that provide reliable electrical connection as well as reliable mechanical connection. There is also an ongoing need for these types of electrical connector apparatus (and methods of electrically connecting apparatus), that are simple to electrically connect. There is also an ongoing need for these types of electrical connector apparatus (and methods of electrically connecting apparatus), that can be connected in small spaces. There is also an ongoing need for these types of electrical connector apparatus (and methods of electrically connecting apparatus), that can be employed in the context of retrofitting replacement apparatus into existing apparatus (e.g., replacing apparatus that comprises one or more light emitters with new apparatus that comprises one or more new light emitters, e.g., one or more solid state light emitters such as light emitting diodes).

BRIEF SUMMARY

The present inventive subject matter provides pivot connectors, electrical connector apparatuses, lighting devices and power input assemblies, and components for such pivot connectors, electrical connector apparatuses, lighting devices and power input assemblies, such power input assemblies configured so that a first electrical connection region in or on such a lighting device can be electrically connected to a second electrical connection region in or on such a power input assembly.

In some aspects of the present inventive subject matter, such electrical connection can be accomplished in a single step using one hand. In some of such aspects, the single step can consist of moving a lighting device in a single direction relative to a power input assembly to accomplish such electrical connection and optionally also mechanical connection between the lighting device and the power input assembly.

In some aspects of the present inventive subject matter, one or more components that is/are involved in providing mechanical and/or electrical connection is/are configured to be pivoted (and/or pivoted relative to one or more other components that is/are involved in providing such mechanical and/or electrical connection), e.g., up to 90 degrees (or more).

In some aspects of the present inventive subject matter, there is provided a connector for connecting to a lighting device, comprising an electrical connector that comprises at least a first portion and a second portion, the first portion rotatable by at least 45 degrees relative to the second portion while maintaining mechanical and electrical engagement between the first portion and the second portion. In some embodiments in accordance with such aspects of the present inventive subject matter:

- the first portion is rotatable relative to the second portion as a result of the first portion being pivotable about a first pivot axis, and/or
- the first portion is rotatable by at least 60 degrees (and in some embodiments at least 75 degrees, at least 90 degrees, at least 105 degrees, at least 120 degrees, at least 135 degrees, at least 150 degrees, at least 165 degrees, or at least 180 degrees.

In some aspects of the present inventive subject matter, there is provided a pivot connector that comprises at least a first retention element and at least a first body element.

In some aspects of the present inventive subject matter, there is provided a pivot connector that comprises at least a first retention element (which comprises at least a first body element interface structure) and at least a first body element (which comprises at least a first retention element interface region).

In some aspects of the present inventive subject matter, there is provided a pivot connector that comprises at least a first retention element, at least a first body element and at least a first holding structure.

In some aspects of the present inventive subject matter, there is provided a power input assembly that comprises at least a first retention element, at least a first body element, at least a first holding structure, at least a first electrical conductor and at least a first electrical connector region.

In some aspects of the present inventive subject matter, there is provided an electrical connector apparatus, comprising a connector for connecting to a lighting device, at least a first electrical conductor and at least a first electrical connector region. In some of such aspects of the present inventive subject matter, the electrical connector apparatus further comprises at least a first light emitter.

In some aspects of the present inventive subject matter, there is provided an electrical connector apparatus, comprising a connector for connecting to a lighting device, at least a first electrical conductor, and a lighting device that comprises at least a first electrical connector region.

In some aspects of the present inventive subject matter, there is provided an electrical connector apparatus that comprises (1) a power input assembly that comprises at least a first retention element, at least a first body element, at least a first holding structure, at least a first electrical conductor and at least a first electrical connector region, and (2) a lighting device that comprises a second electrical connector region and at least one power input assembly engagement region.

The inventive subject matter may be more fully understood with reference to the accompanying drawings and the following detailed description of the inventive subject matter.

BRIEF DESCRIPTION OF THE DRAWING FIGURES

FIG. 1 is an exploded schematic view of a power input assembly 10 in accordance with the present inventive subject matter.

FIGS. 2 and 3 are schematic views of the power input assembly 10 with the addition of a conduit 31 attached thereto.

Figure 6:
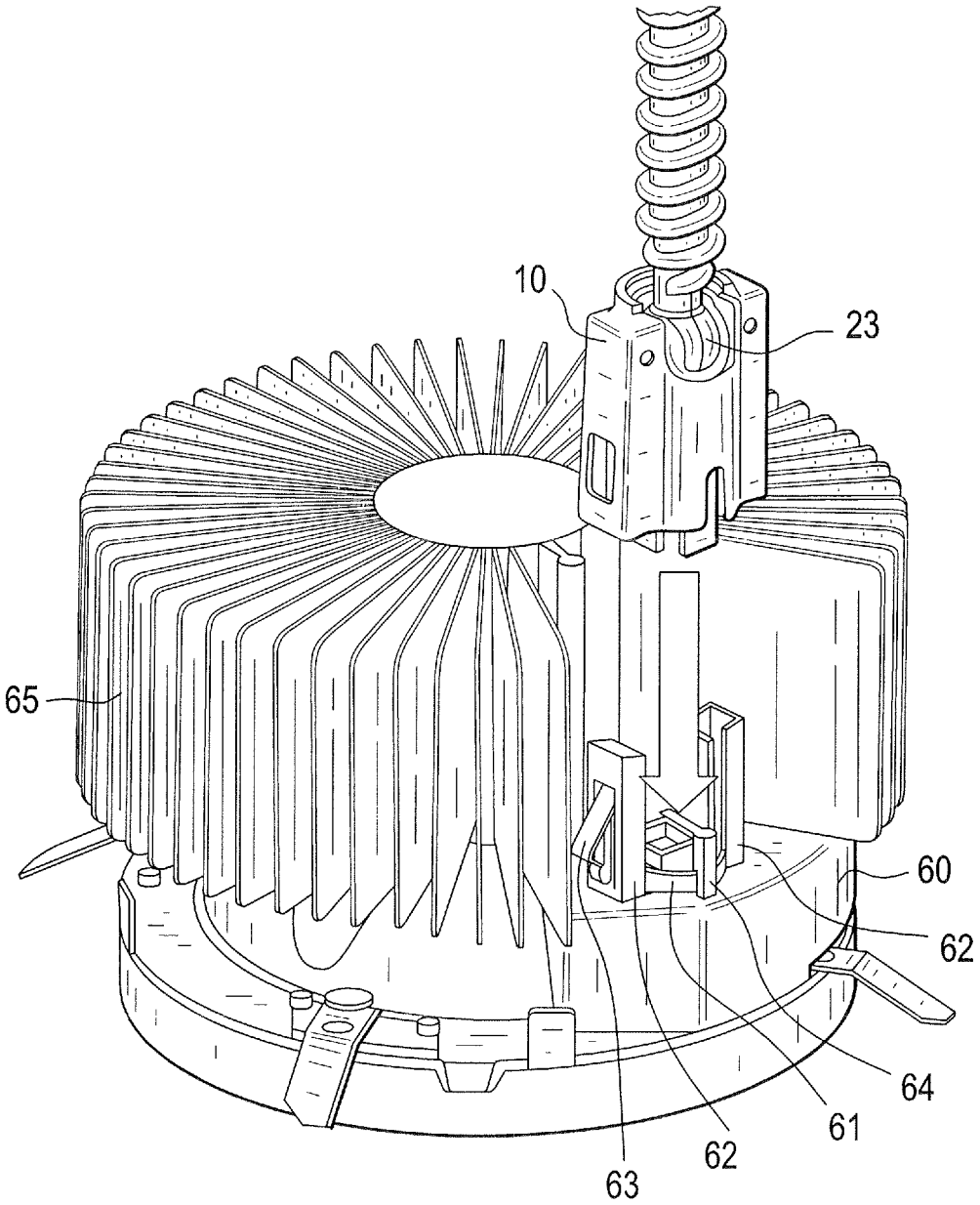

FIG. 6 schematically depicts the power input assembly 10 being moved toward engagement with a lighting device 60.

Figure 7:
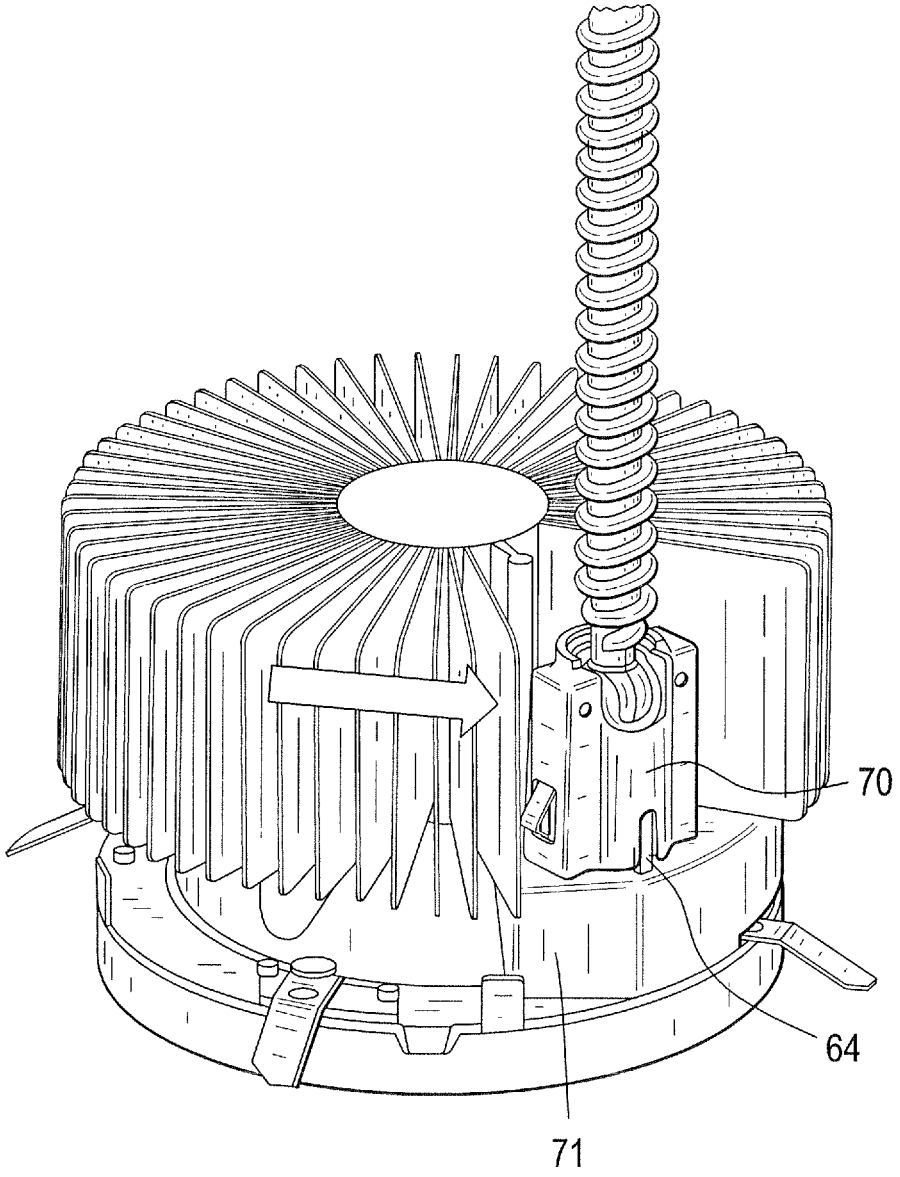

FIG. 7 schematically depicts the power input assembly 10 and the lighting device 60 in an engaged arrangement.

Figure 8:
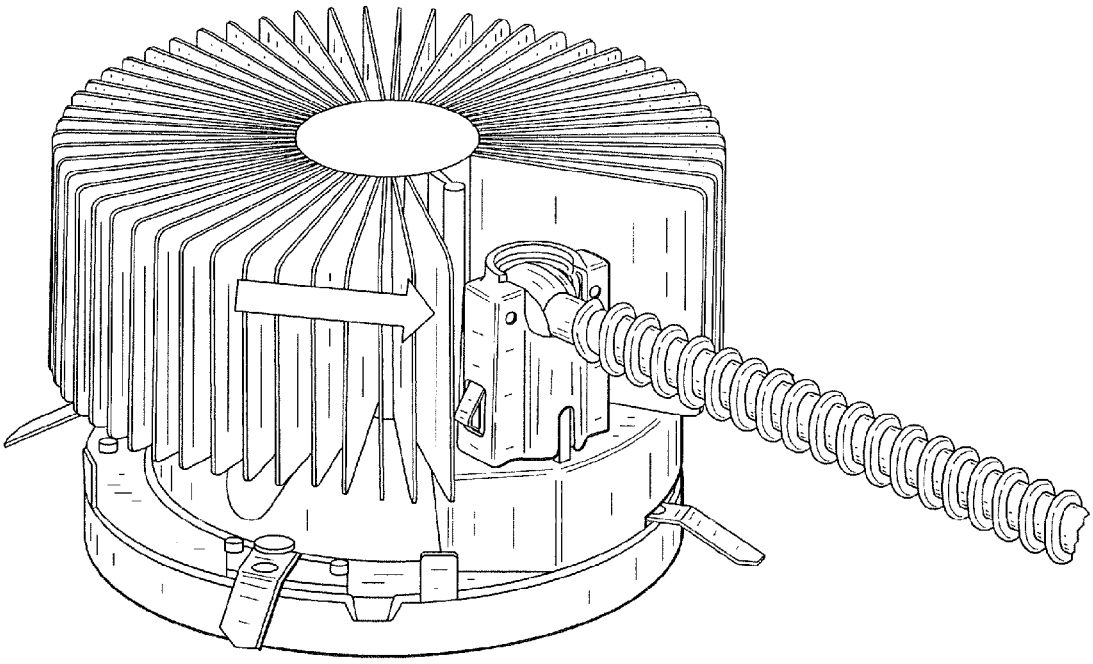

FIG. 8 schematically depicts power input assembly 10 and the lighting device 60 in an engaged arrangement, with the retention element 11 pivoted relative to the body element 12.

Figure 9:
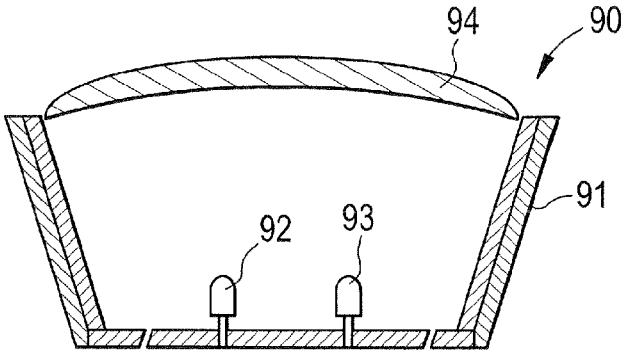

FIG. 9 is a sectional view of a portion of an interior portion of the lighting device 60.

DETAILED DESCRIPTION

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout.

As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on", being mounted "to", or extending "onto" another element, it can be in or on the other element, and/or it can be directly on the other element, and/or it can extend directly onto the other element, and it can be in direct contact or indirect contact with the other element (e.g., intervening elements may also be present). In contrast, when an element is referred to herein as being "directly on" or extending "directly onto" another element, there are no intervening elements present. Also, when an element is referred to herein as being "connected" or "coupled" to another element, it can be directly connected or coupled to the other element, or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed herein could be termed a second element, component, region, layer or section without departing from the teachings of the present inventive subject matter.

The term "region", as used herein, can refer to a portion of a component or an entire component.

The term "structure", as used herein, can refer to a single component, a portion of a single component or two or more components which can each be in contact with at least one other component in the structure, and/or in which one or more component can be spaced from the other component or components in the structure.

The expression "releasably engaged" (e.g., in the expression "the holding structure comprises structure that can be releasably engaged with structure on a lighting device") means that a first structure (i.e., a structure that is referred to as being releasably engaged with a second structure) is inhibited from moving relative to a second structure (e.g., a force of 0.25 N, 0.50 N, 0.75 N, 1.0 N, or more can be applied to the first structure relative to the second structure and the first structure will not move substantially relative to the second structure), and that action can be taken to release that inhibition, e.g., one or more spring elements can be pivoted.

The expression "substantially parallel", as used herein, means that two lines do not diverge from each other by more than 5 degrees.

The expression "light emitter", as used herein, is not limited, except that it indicates that the light emitter is a device that is capable of emitting light. That is, a light emitter can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, in some aspects according to the present inventive subject matter, there is provided a pivot connector that comprises a retention element and a body element. The retention element comprises at least a first body element interface structure, which comprises at least a first pivot alignment structure.

A retention element in accordance with the present inventive subject matter, and/or any component thereof, can comprise any suitable material or combination of materials, and persons of skill in the art can readily select suitable material or materials for use in making a retention element (e.g., a retention element can comprise one or more plastic materials, one or more metals, etc.). A retention element, and/or any component thereof, can have any suitable shape, so long as it provides the functions that are specified for the retention element (or component thereof) in a particular embodiment or aspect of the present inventive subject matter.

In some of such aspects, which can include or not include, as suitable, any of the other features described herein, the retention element can have a region that is substantially cylindrical, except for the presence of one or more conduit engagement structures (e.g., protrusions or bumps) onto which regions of electrical conduit material can be threaded and/or otherwise engaged. The expression "substantially cylindrical", as used herein, means that at least 95% of the points in the surface which is characterized as being substantially cylindrical are located on one of or between a pair of imaginary cylindrical structures which are spaced from each other by a distance of not more than 5% of their largest dimension.

The body element comprises at least a first retention element interface region, which comprises at least a first pivot alignment structure-receiving region.

A body element in accordance with the present inventive subject matter, and/or any component thereof, can comprise any suitable material or combination of materials, and persons of skill in the art can readily select suitable material or materials for use in making a body element (e.g., a body element can comprise one or more plastic materials, one or more metals, etc.). A body element, and/or any component thereof, can have any suitable shape, so long as it provides the functions that are specified for the body element (or component thereof) in a particular embodiment or aspect of the present inventive subject matter.

In some of such aspects, which can include or not include, as suitable, any of the other features described herein, there is provided a body element that comprises at least a first body structure and a second body structure. A body structure in accordance with the present inventive subject matter, and/or any component thereof, can comprise any suitable material or combination of materials, and persons of skill in the art can readily select suitable material or materials for use in making a body structure. A body structure, and/or any component thereof, can have any suitable shape, so long as it provides the functions that are specified for that body structure (or component thereof) in a particular embodiment or aspect of the present inventive subject matter. In any aspect of the present inventive subject matter that comprises two or more body structures, the respective body structures can be similar or different (or any number of body structures can be similar or different).

In aspects in which the body element comprises at least a first body structure and a second body structure, the first body structure and the second body structure can be connected to one another (e.g., during assembly of a pivot connector) to form the body element. In some of such aspects, one or more alignment features can be provided to help ensure that the respective body structures are aligned properly with respect to each other and/or held in place relative to one another, e.g., (1) a first body structure can have one or more protrusions that extend into one or more recesses in a second body structure when the first body structure and the second body structure are properly aligned, and/or (2) a first body structure can have one or more recesses into which one or more protrusions on a second body structure extend when the first body structure and the second body structure are properly aligned, and/or (3) one or more alignment elements (e.g., in the shape of pins that have a substantially uniform cross-section over at least part of their long dimension, e.g., cylindrical pins or square or rectangular pegs, which can optionally be tapered on one or both ends), can be provided which extend through respective openings and/or into respective recesses in at least first and second body structures (in some of such aspects, one or more of such alignment elements and/or regions of one or more body structures can be treated, e.g., with heat and/or adhesive, in order to enhance the strength of retaining the respective body structures in alignment relative to one another, e.g., as heat stakes).

The retention element and the body element are configured such that the retention element can pivot relative to the body element. The range of pivotal movement can be any suitable amount (e.g., up to 90 degrees, up to 180 degrees, up to 270 degrees, up to 20 degrees, up to 30 degrees, up to 40 degrees, up to 50 degrees, up to 60 degrees, up to 70 degrees, up to 80 degrees, up to 100 degrees, up to 110 degrees, up to 120 degrees, up to 130 degrees, up to 140 degrees, up to 150 degrees, up to 160 degrees, up to 170 degrees, etc.).

In some of such aspects, which can include or not include, as suitable, any of the other features described herein, the first pivot alignment structure (of the first body element interface structure) is in the first pivot alignment structure-receiving region of the first retention element interface region of the body element, and can rotate therein to provide at least some of the range of pivotal movement.

In some of such aspects, which can include or not include, as suitable, any of the other features described herein, at least a first portion of the first pivot alignment structure is radially substantially symmetrical, over at least a first angular range, with respect to an axis of the first portion of the first pivot alignment structure, and the first portion of the first pivot alignment structure is in the first pivot alignment structure-receiving region. The expression "radially substantially symmetrical," as used herein, means that there exists an axis, and a series of planes that are perpendicular to the axis and that include a respective series of points along the axis that fill a segment of the axis, in which for each plane, outer extremities of a portion of a structure (i.e., the portion of a structure that is being characterized as radially substantially symmetrical), in the plane are each spaced from the axis by respective distances that differ by no more than 5 percent, for at least 95 percent of all whole integer angles (i.e., 1 degree, 2 degrees, 3 degrees, . . . 359 degrees and 360 degrees) in the plane and around the axis. Accordingly, the expression "at least a first portion of the first pivot alignment structure is radially substantially symmetrical, over at least a first angular range, with respect to an axis of the first portion of the first pivot alignment structure" means that there exists an axis, and a series of planes that are perpendicular to the axis and that include a respective series of points along the axis that fill a segment of the axis, in which for each plane, outer extremities of a portion of a structure in the plane (i.e., the portion of a structure that is being characterized as radially substantially symmetrical) over a first angular range (i.e., over an angular range relative to a plane that includes the axis, e.g., 90 degrees as opposed to the full 360 degrees, for at least 95 percent of the whole integer angles within such range), are each spaced from the axis by respective distances that differ by no more than 5 percent.

In some of such aspects, which can include or not include, as suitable, any of the other features described herein, at least a first portion of the first pivot alignment structure is radially asymmetrical to enough of an extent that the first portion of the first pivot alignment structure can snap or click while pivoting in the first pivot alignment structure-receiving region to specific angular positions.

In some of such aspects, which can include or not include, as suitable, any of the other features described herein, at least a first portion of the first pivot alignment structure-receiving region is radially substantially symmetrical, over at least a first angular range, with respect to an axis of the first portion of the first pivot alignment structure-receiving region, and the first portion of the first pivot alignment structure is in the first pivot alignment structure-receiving region.

In some of such aspects, which can include or not include, as suitable, any of the other features described herein, at least a first portion of the first pivot alignment structure-receiving region is radially asymmetrical to enough of an extent that the first portion of the first pivot alignment structure can snap or click while pivoting in the first pivot alignment structure-receiving region to specific angular positions.

In some of such aspects, which can include or not include, as suitable, any of the other features described herein the retention element comprises a second body element interface structure, which comprises a second pivot alignment structure, the body element comprises a second retention element interface region, which comprises a second pivot alignment structure-receiving region, and (1) at least a first part of the second pivot alignment structure is radially substantially symmetrical, over at least a first angular range, with respect to an axis of the first part of the second pivot alignment structure, and the first part of the second pivot alignment structure is in the second pivot alignment structure-receiving region (or the first part of the second pivot alignment structure is asymmetrical (e.g., to enough of an extent that the first portion of the first pivot alignment structure can snap or click while pivoting in the first pivot alignment structure-receiving region to specific angular positions)), and/or (2) at least a first part of the second pivot alignment structure-receiving region is radially substantially symmetrical, over at least a first angular range, with respect to an axis of the first part of the second pivot alignment structure-receiving region, and the first part of the second pivot alignment structure is in the second pivot alignment structure-receiving region (or the first part of the second pivot alignment structure-receiving region is asymmetrical (e.g., to enough of an extent that the first portion of the first pivot alignment structure can snap or click while pivoting in the first pivot alignment structure-receiving region to specific angular positions)).

In some of such aspects, which can include or not include, as suitable, any of the other features described herein, the pivotal movement (of the retention element relative to the body element) can be relative to an axis of a first portion of a first pivot alignment structure of the retention element and/or relative to an axis of a first portion of a first pivot alignment structure-receiving region of the body element. In some of such aspects, which can include or not include, as suitable, any of the other features described herein, the pivotal movement (of the retention element relative to the body element) can be relative to an axis that extends through respective portions of at least two pivot alignment structures of the retention element and/or relative to an axis of respective portions of at least two pivot alignment structure-receiving regions of the body element.

In some of such aspects, which can include or not include, as suitable, any of the other features described herein, the retention element further comprises a substantially spherical region, the body element further comprises a substantially spherical region-receiving structure, and the substantially spherical region of the retention element is in the substantially spherical region-receiving structure of the body element. The expression "substantially spherical," as used herein, means that there exists a point from which portions of the region being characterized as substantially spherical are spaced respective distances that are each within 5 percent of a particular value, and such portions of the region being characterized as substantially spherical cover at least 50 percent (and in some aspects, at least 60 percent, at least 65 percent, at least 70 percent, at least 75 percent, at least 80 percent, at least 85 percent or at least 90 percent) of all angular directions from such point.

In some of such aspects, which can include or not include, as suitable, any of the other features described herein, the retention element and/or the body element comprises a substantially spherical region.

In some of such aspects, which can include or not include, as suitable, any of the other features described herein:

the retention element comprises a second body element interface structure, which comprises a second pivot alignment structure, the body element comprises a second retention element interface region, which comprises a second pivot alignment structure-receiving region, at least a first part of the second pivot alignment structure is radially substantially symmetrical (or asymmetrical in the sense described above with respect to other structures), over at least a first angular range, with respect to an axis of the first portion of the first pivot alignment structure, the first part of the second pivot alignment structure is in the second pivot alignment structure-receiving region, the retention element further comprises a substantially spherical region, the body element further comprises a substantially spherical region-receiving structure, the substantially spherical region of the retention element is in the substantially spherical region-receiving structure of the body element, and the axis of the first portion of the first pivot alignment structure passes through a center of a sphere defined by the substantially spherical region of the retention element.

In some of such aspects, which can include or not include, as suitable, any of the other features described herein:

the retention element comprises a second body element interface structure, which comprises a second pivot alignment structure, the body element comprises a second retention element interface region, which comprises a second pivot alignment structure-receiving region, at least a first part of the second pivot alignment structure-receiving region is radially substantially symmetrical (or asymmetrical in the sense described above with respect to other structures), over at least a first angular range, with respect to an axis of the first portion of the first pivot alignment structure-receiving region, the first part of the second pivot alignment structure is in the second pivot alignment structure-receiving region, the retention element further comprises a substantially spherical region, the body element further comprises a substantially spherical region-receiving structure, the substantially spherical region of the retention element is in the substantially spherical region-receiving structure of the body element, and the axis of the first portion of the first pivot alignment structure passes through a center of a sphere defined by the substantially spherical region of the retention element.

In some of such aspects, which can include or not include, as suitable, any of the other features described herein, there is provided a pivot connector that comprises a retention element, and body element and at least a first holding structure that comprises at least a first lighting device engagement region, and the body element is held in place relative to the first holding structure. In some of such aspects, the holding structure comprises structure (e.g., a lighting device engagement region) that can be releasably engaged with structure on a lighting device (e.g., an engagement region-receiving structure), (e.g., (1) the holding structure can comprise a lighting device engagement region (in the form of at least a first spring element) that can be releasably engaged with an engagement region-receiving structure (in the form of a spring element-receiving region) on the lighting device, and/or (2) the holding structure can comprise at least a first spring element-receiving region that can be releasably engaged with a spring element on the lighting device).

A spring element (if included) can comprise any suitable spring element, a wide variety of which are well known to persons of skill in the art. A spring element can be any structure (1) which normally occupies a first position, (2) to which an external force can be applied to cause the spring element to move (e.g., to bend relative to a point or line), e.g., to a second position, and (3) which moves back toward (and in some cases, back to) the first position when the external force is removed.

A spring element-receiving region (if included) can comprise any suitable structure capable of receiving at least a portion of a spring element, a wide variety of which (e.g., a recess or an opening) will be readily apparent to persons of skill in the art. For example, in some aspects, a lighting device engagement region can comprise a spring element that is configured to be received in an engagement region-receiving structure (e.g., on a lighting device), while in some aspects, a lighting device engagement region can comprise an opening or a recess that is configured to receive a spring element (e.g., on a lighting device), and in some aspects, combinations of such structures can be provided. Alternatively or additionally, friction fitting (or any other suitable mechanical engagement) can be employed in place or (or in addition to) a flex element or spring element and corresponding receiving element.

A holding structure in accordance with the present inventive subject matter, and/or any component thereof, can comprise any suitable material or combination of materials, and persons of skill in the art can readily select suitable material or materials for use in making a holding structure. A holding structure, and/or any component thereof, can have any suitable shape, so long as it provides the functions that are specified for that holding structure (or component thereof) in a particular embodiment or aspect of the present inventive subject matter. In any aspect of the present inventive subject matter that comprises two or more holding structures, the respective holding structures can be similar or different (or any number of holding structures can be similar or different).

In some of such aspects, which can include or not include, as suitable, any of the other features described herein, there is provided a pivot connector that comprises a body element, a retention element and at least a first holding structure that comprises at least a first alignment region, in which the body element comprises at least a second alignment region, and the pivot connector further comprises at least a first retention structure that extends through at least a portion of the first alignment region and through at least a portion of the second alignment region to hold the body element in place relative to the first holding structure.

In some of such aspects, which can include or not include, as suitable, any of the other features described herein, there is provided a pivot connector that comprises a body element, a retention element and at least a first holding structure that comprises at least a first keying structure which is removably engageable with a first keying region of a lighting device. The expression "removably engageable", as used herein in connection with two or more, means that one of the two structures is capable of coming into contact with the other of the two structures, and that action can be taken (without damaging either structure) to move one or both of the structures to discontinue (at least temporarily) such contact.

In any aspect of the present inventive subject matter that comprises two or more keying structures, the respective keying structures can be similar or different (or any number of keying structures can be similar or different).

In any aspect of the present inventive subject matter that comprises two or more keying regions, the respective keying regions can be similar or different (or any number of keying regions can be similar or different).

In some of such aspects, which can include or not include, as suitable, any of the other features described herein, there is provided a power input assembly that comprises a pivot connector as described herein, a second electrical connector region and at least a first electrical conductor (e.g., a wire), the first electrical conductor extending through an internal space defined by the retention element, the first electrical conductor electrically connected to the second electrical connector region. In some of such aspects, the body element comprises at least a first body structure and a second body structure, and at least a portion of the second electrical connector region is between (1) at least a portion of the first body structure and (2) at least a portion of the second body structure.

An electrical connector region can comprise any suitable electrical connector region, e.g., a second electrical connector region can comprise a plurality of conductive pins (each of the pins aligned, e.g., any pin can have an axis that extends in a direction that is parallel to a direction in which an axis of at least one other pin extends), a plurality of recesses or openings (in which one or more regions of the surfaces that define the recesses or openings are conductive), a plurality of contacts (e.g., bumps or generally flat surfaces), etc., and/or combinations thereof.

In any aspect of the present inventive subject matter that comprises two or more electrical connector regions, the respective electrical connector regions can be similar or different (or any number of electrical connector regions can be similar or different).

In some of such aspects, which can include or not include, as suitable, any of the other features described herein, there is provided an electrical connector apparatus that comprises (1) a power input assembly that comprises a body element, a retention element, and a holding structure (which comprises at least a first lighting device engagement region), at least a first electrical conductor, and a second electrical conductor region, and (2) a lighting device that comprises an electrical connector region and at least a first engagement region-receiving structure. In some of such aspects, the holding structure (of the power input assembly) comprises structure that can be releasably engaged with structure on a lighting device (which can comprise at least one light emitter), (e.g., (1) the holding structure can comprise at least a first spring element that can be releasably engaged with a spring element-receiving region on the lighting device, and/or (2) the holding structure can comprise at least a first spring element-receiving region that can be releasably engaged with a spring element on the lighting device). In some of such aspects, the holding structure (of the power input assembly) can comprise at least a first keying structure which is removably engageable with a first keying region of a lighting device.

In some aspects according to the present inventive subject matter, there is provided an electrical connector apparatus that comprises (1) a power input assembly that comprises a body element, a retention element, a holding structure (which comprises at least one lighting device engagement region), an electrical conductor, and a second electrical connector region, and (2) a lighting device that comprises a second electrical connector region and an engagement region-receiving structure.

In any such aspect, the second electrical connector region can comprise any suitable electrical connector region, e.g., any of those discussed above in relation to the second electrical connector region. As noted above, in any aspect of the present inventive subject matter that comprises two or more electrical connector regions, the respective electrical connector region can be similar or different (or any number of electrical connector regions can be similar or different).

As indicated above, in some of such aspects, which can include or not include, as suitable, any of the other features described herein, an engagement region-receiving structure can comprises at least one spring element and/or an engagement region-receiving structure comprises at least one spring element-receiving region.

As indicated above, in some of such aspects, which can include or not include, as suitable, any of the other features described herein, there can be included a lighting device that comprises at least one light emitter. In aspects according to the present inventive subject matter that comprise one or more light emitters, the light emitter(s) can be any suitable device capable of emitting light. Persons of skill in the art are familiar with, and have ready access to, a wide variety of light emitters (which can, e.g., emit white light, light of any suitable color, or light of a combination of different colors), and any suitable light emitter(s) can be employed in accordance with the present inventive subject matter. Representative examples of types of light emitters include incandescent lights, fluorescent lamps, solid state light emitters (e.g., light emitting diodes), laser diodes, thin film electroluminescent devices, light emitting polymers (LEPs), halogen lamps, high intensity discharge lamps, electron-stimulated luminescence lamps, etc., with or without filters. That is, the at least one light emitter can comprise a single light emitter, a plurality of light emitters of a particular type, or any combination of one or more light emitters of each of a plurality of types.

The present inventive subject matter is applicable to lighting devices of any size or shape, including flood lights, spot lights, downlights, and all other general residential or commercial illumination products.

The lighting devices of the present inventive subject matter can be arranged in generally any suitable orientation, a variety of which are well known to persons skilled in the art. For example, the lighting device can be a back-reflecting device or a front-emitting device.

Solid state light emitters are of great importance, in view of their energy efficiency as well as other properties (e.g., their ability to be configured to achieve high CRI Ra and/or high brightness, their ability to be used to provide compact designs, etc.). Persons of skill in the art are familiar with, and have ready access to, a wide variety of solid state light emitters, and any suitable solid state light emitter (or solid state light emitters) can be employed in the lighting devices or lighting device elements according to the present inventive subject matter. Representative examples of solid state light emitters include light emitting diodes (inorganic or organic, including polymer light emitting diodes (PLEDs)) and a wide variety of luminescent materials as well as combinations (e.g., one or more light emitting diodes and/or one or more luminescent materials).

Persons of skill in the art are familiar with, have ready access to, and can readily make, a variety of solid state light emitters which, when illuminated, emit light of any of a wide variety of wavelengths, ranges of wavelengths, dominant emission wavelengths and peak emission wavelength (e.g., they can emit infrared light, visible light, ultraviolet light, near ultraviolet light, etc., and any combinations thereof), and any of such solid state light emitters, or any combinations of such solid state light emitters, can be employed as a light emitter (or as light emitters) in accordance with the present inventive subject matter.

In any lighting device according to the present inventive subject matter that comprises one or more solid state light emitters, such one or more solid state light emitters can be of any suitable size (or sizes), and any quantity (or respective quantities) of solid state light emitters of one or more sizes can be employed. In some instances, for example, a greater quantity of smaller solid state light emitters can be substituted for a smaller quantity of larger solid state light emitters, or vice-versa.

In any lighting device according to the present inventive subject matter that comprises one or more solid state light emitters, such one or more solid state light emitters can be arranged in any desired way.

A luminescent material is a material that emits a responsive radiation (e.g., visible light) when excited by a source of exciting radiation. In many instances, the responsive radiation has a wavelength (or hue) that is different from the wavelength (or hue) of the exciting radiation.

Luminescent materials can be categorized as being down-converting, i.e., a material that converts photons to a lower energy level (longer wavelength) or up-converting, i.e., a material that converts photons to a higher energy level (shorter wavelength).

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

One type of luminescent material are phosphors, which are readily available and well known to persons of skill in the art. Other examples of luminescent materials include scintillators, day glow tapes and inks that glow in the visible spectrum upon illumination with ultraviolet light.

One or more luminescent materials, if included, can be provided in any suitable form. For example, one or more luminescent materials can be embedded in a resin (i.e., a polymeric matrix), such as a silicone material, an epoxy material, a glass material or a metal oxide material, and/or can be applied to one or more surfaces of a resin. For example, inclusion of one or more luminescent materials (if desired) can be accomplished by adding the luminescent material (or materials) to a clear or translucent encapsulant material (e.g., epoxy-based, silicone-based, glass-based or metal oxide-based material), for example by a blending or coating process.

Solid state light emitters (if employed) can be connected to the lighting device in any suitable way, e.g., by using chip on heat sink mounting techniques, by soldering (e.g., to a metal core printed circuit board (MCPCB), flex circuit or even a standard PCB, such as an FR4 board with thermal vias), for example, solid state light emitters can be mounted using substrate techniques such as from Thermastrate Ltd of Northumberland, UK. If desired, a surface of a structure or region on which one or more solid state light emitters is to be on and/or a surface (or surfaces) of the one or more solid state light emitters can be machined or otherwise formed, e.g., to be of matching topography so as to provide good adhesion and/or high heat sink surface area.

In some lighting devices, one or more solid state light emitters can be mounted directly on a portion of the lighting device, e.g., on a trim element.

As indicated above, in some of such aspects, which can include or not include, as suitable, any of the other features described herein, there is provided a power input assembly that comprises at least one electrical conductor. Persons of skill in the art are familiar with a variety of electrical conductors (e.g., wires and various assemblies that include wires, traces, conductive tracks, buses, etc.), and any suitable electrical conductor(s) can be employed in aspects that comprise one or more electrical conductors.

In some aspects according to the present inventive subject matter, there is provided a power input assembly that comprises at least one conduit, through at least a portion of which one or more electrical conductors can extend or be fed. Persons of skill in the art are familiar with a variety of conduits (e.g., corrugated metal conduits (e.g., Kaiphoneflex), e.g., helically corrugated metal conduits), and any suitable conduit(s) cam be employed in aspects that comprise one or more conduits.

In some aspects according to the present inventive subject matter, there is provided a lamp that comprises (1) at least one lighting device that corresponds to any of the lighting devices described herein and (2) at least one power input assembly that corresponds to any of the power input assemblies described herein.

Lamps and lighting devices in accordance with the present inventive subject matter can comprise any suitable circuitry, including any suitable dimming circuitry, any suitable power supply circuitry, any suitable driver circuitry, any suitable wiring pattern, any suitable circuitry for achieving a degree of voltage matching, color maintenance circuitry, power factor correction circuitry, etc.

Lamps and lighting devices in accordance with the present inventive subject matter can comprise any suitable housing structures, fixture components, enclosing structures, light mixing chambers, etc.

Lamps and lighting devices in accordance with the present inventive subject matter can comprise any suitable heat dissipation features or components, a wide variety of which are well known to persons of skill in the art (including wide varieties of passive and active (i.e., requiring supply of energy for the component(s) to operate) cooling components).

Lamps and lighting devices in accordance with the present inventive subject matter can comprise one or more lenses, diffusers or light control elements. Persons of skill in the art are familiar with a wide variety of lenses, diffusers and light control elements, can readily envision a variety of materials out of which a lens, a diffuser, or a light control element can be made (e.g., polycarbonate materials, acrylic materials, fused silica, polystyrene, etc.), and are familiar with and/or can envision a wide variety of shapes that lenses, diffusers and light control elements can be. Any of such materials and/or shapes can be employed in a lens and/or a diffuser and/or a light control element in an aspect that includes a lens and/or a diffuser and/or a light control element. As will be understood by persons skilled in the art, a lens or a diffuser or a light control element in a lamp or a lighting device according to the present inventive subject matter can be selected to have any desired effect on incident light (or no effect), such as focusing, diffusing, etc. Any such lens and/or diffuser and/or light control element can comprise one or more luminescent materials, e.g., one or more phosphor.

In aspects in accordance with the present inventive subject matter that include a lens (or plural lenses), the lens (or lenses) can be positioned in any suitable location and orientation.

In aspects in accordance with the present inventive subject matter that include a diffuser (or plural diffusers), the diffuser (or diffusers) can be positioned in any suitable location and orientation. In some aspects, which can include or not include any of the features described elsewhere herein, a diffuser can be provided over a top or any other part of the lamp or lighting device, and the diffuser can comprise one or more luminescent material (e.g., in particulate form) spread throughout a portion of the diffuser or an entirety of the diffuser.

In aspects in accordance with the present inventive subject matter that include a light control element (or plural light control elements), the light control element (or light control elements) can be positioned in any suitable location and orientation. Persons of skill in the art are familiar with a variety of light control elements, and any of such light control elements can be employed.

In addition, one or more scattering elements (e.g., layers) can optionally be included in the lamps and lighting devices according to the present inventive subject matter. For example, a scattering element can be included in a resin along with luminescent material, and/or a separate scattering element can be provided. A wide variety of separate scattering elements and combined luminescent and scattering elements are well known to those of skill in the art, and any such elements can be employed in the lighting devices of the present inventive subject matter.

In some aspects of the present inventive subject matter, there are provided lamps and lighting devices that can provide lumen output of at least 600 lumens, and in some aspects at least 750 lumens, at least 900 lumens, at least 1000 lumens, at least 1100 lumens, at least 1200 lumens, at least 1300 lumens, at least 1400 lumens, at least 1500 lumens, at least 1600 lumens, at least 1700 lumens, at least 1800 lumens (or in some cases at least even higher lumen outputs), and/or CRI Ra of at least 70, and in some aspects at least 80, at least 85, at least 90 or at least 95).

The lamps and lighting devices according to the present inventive subject matter can direct light in any desired range of directions.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Figure 1:
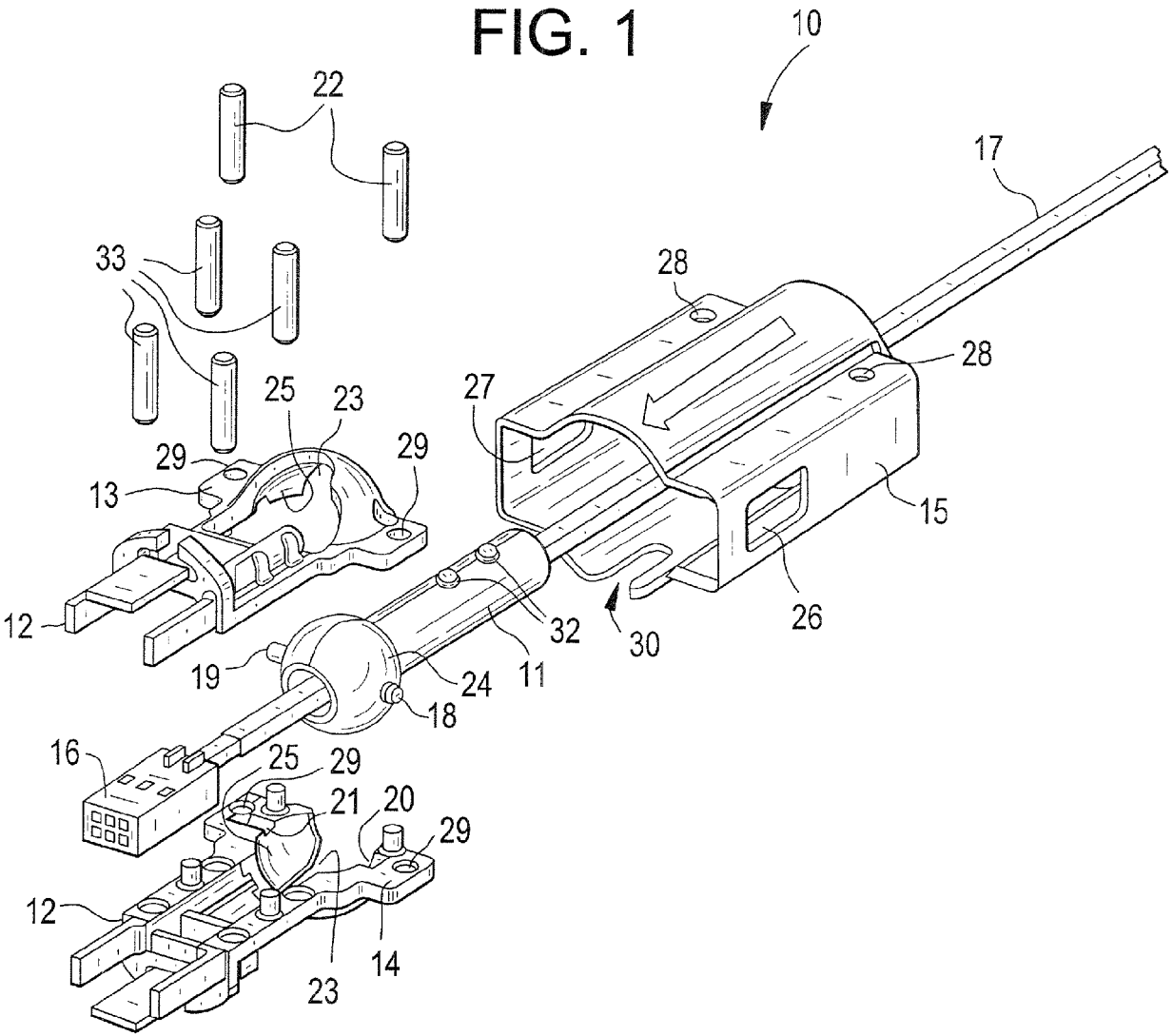

FIG. 1 is an exploded schematic view of a power input assembly 10 in accordance with the present inventive subject matter. Referring to FIG. 1, the power input assembly 10 comprises a retention element 11, a body element 12 (in this exploded view, shown as a first body structure 13 and a second body structure 14), a holding structure 15, a first electrical connector region 16 and two electrical conductors 17 (in the form of wires).

The retention element 11 comprises a first body element interface structure in the form of a first pivot alignment structure 18, and a second body element interface structure in the form of a second pivot alignment structure 19.

The body element 12 comprises a first retention element interface region in the form of a first pivot alignment structure-receiving region 20. The body element 12 comprises a second retention element interface region in the form of a second pivot alignment structure-receiving region 21. A plurality of retention structures 33 each extend through apertures in both the first body structure 13 and the second body structure 14.

The first pivot alignment structure 18 is substantially cylindrical, whereby it is radially substantially symmetrical (over 360 degrees) with respect to an axis of the first pivot alignment structure, and the first pivot alignment structure 18 is in the first pivot alignment structure-receiving region 20.

The second pivot alignment structure 19 is also substantially cylindrical (and therefore is radially substantially symmetrical over 360 degrees) with respect to an axis of the second pivot alignment structure, the second pivot alignment structure 19 is in the second pivot alignment structure-receiving region 21, and the axis of the second pivot alignment structure is identical to the axis of the first pivot alignment structure.

Figure 3:
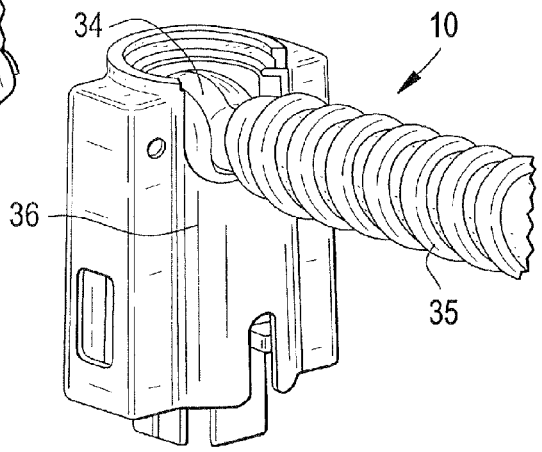

The retention element 11 can be rotated 180 degrees about the axis of the first pivot alignment structure, and a substantially cylindrical portion of the retention element 11 can be accommodated by notches 23 (in this embodiment, in the form of generally U-shaped open structures, more readily visible, e.g., in FIGS. 3 and 6) in the first body structure 13 and in the second body structure 14, when the retention element 11 is pivoted about the axis of the first and second pivot alignment structures in either direction relative to the orientation depicted in FIG. 1.

The retention element 11 further comprises a substantially spherical region 24, and the body element 12 further comprises a substantially spherical region-receiving structure 25, and the substantially spherical region 24 of the retention element 11 is in the substantially spherical region-receiving structure 25 of the body element 12. The axis of the first pivot alignment structure 18 (which is the same as the axis of the second pivot alignment structure 19) passes through a center of a sphere defined by the substantially spherical region 24 of the retention element 11.

The holding structure 15 comprises a first lighting device engagement region 26 and a second lighting device engagement region 27. The holding structure 15 also comprises a pair of alignment regions 28 (each in the form of a hole on opposite sides of the holding structure 15, only the holes in one side of the holding structure 15 being visible in FIG. 1), the body element 12 comprises a corresponding pair of alignment regions 29, and the power input assembly comprises a pair of retention structures 22 that each extend through one of the alignment regions 28 and one of the alignment regions 29 to hold the body element 12 in place relative to the holding structure 15. The holding structure 15 also comprises at least a first keying structure 30. The holding structure 15 comprises a notch 34 (see, e.g., FIG. 3) which can accommodate the retention element 11 (e.g., in this embodiment, the substantially cylindrical portion of the retention element 11) when the retention element 11 is rotated.

The electrical conductors 17 extend through an internal space defined by the retention element 11, and they are electrically connected to the first electrical connector region 16. The first electrical connector region is between (1) at least a portion of the first body structure 13 and (2) at least a portion of the second body structure 14.

Figure 2:
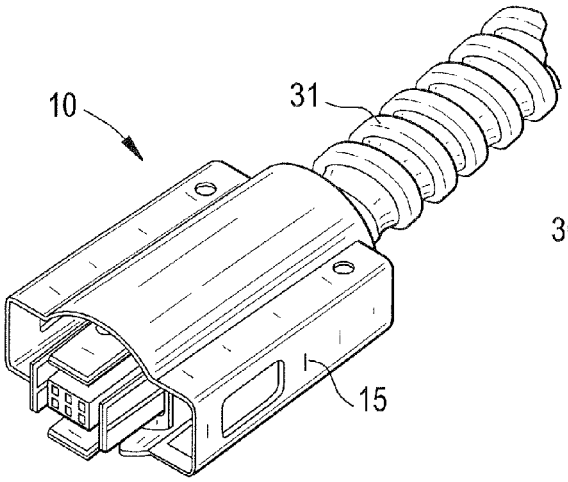

The power input assembly 10 is also depicted (in non-exploded schematic views) in FIG. 2 and in FIG. 3, with the addition of a conduit 31 attached thereto. The conduit 31 can be threaded onto conduit engagement structures 32 (visible in FIG. 1) (each in the faun of a raised portion) on the retention element 11. FIG. 2 depicts the power input assembly 10 in a non-rotated orientation (i.e., with the same pivotal orientation of the retention element 11 relative to the body element 12 as depicted in FIG. 1), and FIG. 3 depicts the power input assembly 10 in a 90 degree-rotated orientation.

As described above, in some aspects in accordance with the present inventive subject matter, there is provided a connector for connecting to a lighting device, comprising an electrical connector that comprises at least a first portion and a second portion, the first portion rotatable by at least 45 degrees relative to the second portion while maintaining mechanical and electrical engagement between the first portion and the second portion. In an embodiment as depicted in FIG. 3, there is depicted a connector for connecting to a lighting device, comprising an electrical connector that comprises at least a first portion 35 and a second portion 36, the first portion 35 rotatable by at least 45 degrees relative to the second portion 36 while maintaining mechanical and electrical engagement (e.g., with a wire extending through them) between the first portion 35 and the second portion 36. The first portion 35 is rotatable relative to the second portion 36 as a result of the first portion 35 being pivotable about a first pivot axis (extending through the first pivot alignment structure 18 and the second pivot alignment structure 19 (see FIG. 1). In this embodiment, the first portion 35 is rotatable by about 90 degrees relative to the second portion 36.

Figure 4:
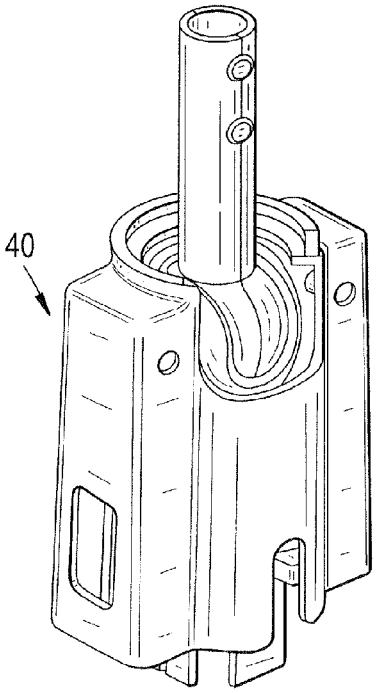
FIG. 4 depicts a pivot connector 40 employed in the power input assembly 10.
Figure 5:
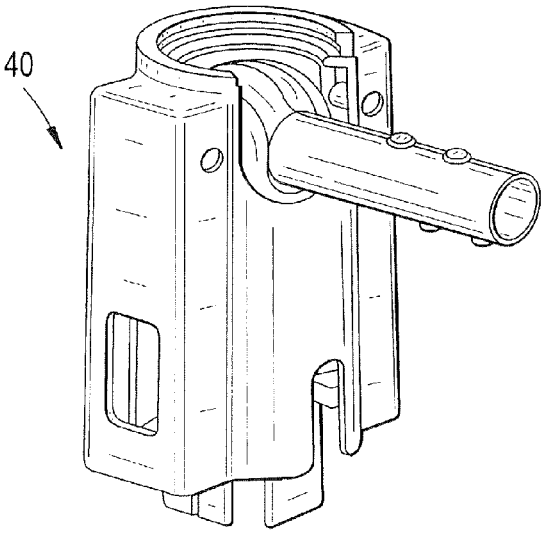
FIG. 5 depicts the pivot connector 40 in a 90 degree-rotated orientation.

FIG. 4 schematically depicts the power input assembly 10 without the electrical conductors 17 (and without the conduit 31), i.e., FIG. 4 depicts a pivot connector 40 employed in the power input assembly 10. FIG. 4 depicts the pivot connector 40 in a non-rotated orientation (i.e., with the same pivotal orientation of the retention element 11 relative to the body element 12 as depicted in FIG. 1), and FIG. 5 depicts the pivot connector 40 in a 90 degree-rotated orientation.

FIG. 6 schematically depicts the power input assembly 10 being moved toward engagement with a lighting device 60. The lighting device 60 comprises a second electrical connector region 61, a pair of power input assembly engagement regions 62, a keying region 64, and a plurality of heat dissipation fins 65. Each of the power input assembly engagement regions 62 comprises a spring element 63. The respective power input assembly engagement regions 62 are on opposite sides relative to the second electrical connector region 61. The keying region 64 comprises a protrusion.

FIG. 7 schematically depicts the power input assembly 10 and the lighting device 60 in an engaged arrangement. In this arrangement:

(1) the respective spring elements 63 of the power input assembly engagement regions 62 of the lighting device 60 are received (i.e., releasably engaged) in the respective lighting device engagement regions 26 and 27 of the power input assembly 10;

(2) the first electrical connector region 16 of the power input assembly 10 is removably engaged (thereby providing electrical connection) with the second electrical connector region 61 of the lighting device 60; and (3) the keying structure of the holding structure 15 is removably engaged with the keying region 64 of the lighting device 60.

From the arrangement depicted in FIG. 7, the power input assembly can be pivoted (i.e., the retention element 11 can be pivoted relative to the body element 12) up to 90 degrees, e.g., to the orientation depicted in FIG. 8, whereby the overall dimension of the arrangement in the vertical direction (in the orientation depicted in FIG. 8), i.e., in a direction along an axis through which each of the planes defined by the heat dissipation fins 65 pass, can be reduced (and/or such dimension of the lighting device 60 can be not affected by the engagement of the power input assembly 10 with the lighting device 60).

As described above, in some aspects in accordance with the present inventive subject matter, there is provided an electrical connector apparatus, comprising a connector for connecting to a lighting device, at least a first electrical conductor, and at least a first electrical connector region. In an embodiment as depicted in FIGS. 7 and 8, there is depicted an electrical connector apparatus, comprising a connector 70 for connecting to a lighting device 71, at least a first electrical conductor (e.g., a pair of electrical conductors 17 (see FIG. 1), such as wires), an electrical connector region 61 (see FIG. 6), and at least a first light emitter (e.g., light emitters 92 and 93 (see FIG. 9).

As described above, in some aspects in accordance with the present inventive subject matter, there is provided an electrical connector apparatus, comprising a connector for connecting to a lighting device, and a lighting device that comprises at least a first electrical conductor and at least a first electrical connector region. In an embodiment as depicted in FIGS. 7 and 8, there is depicted an electrical connector apparatus, comprising a connector 70 for connecting to a lighting device, at least a first electrical conductor (e.g., a pair of electrical conductors 17 (see FIG. 1), such as wires), and a lighting device 71 that comprises at least a first electrical connector region 61.

FIG. 9 is a sectional view of a portion of an interior portion of the lighting device 60. Referring to FIG. 9, the lighting device 60 comprises a trim element 91, a first light emitter 92, a second light emitter 93, and a diffuser 94.

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lamps, lighting devices, power input assemblies and lighting device positioning apparatuses described herein can be integrated. Any structural part of the lamps, lighting devices and power input assemblies described herein can be provided in two or more parts (which may be held together in any known way, e.g., with adhesive, screws, bolts, rivets, staples, etc.). Similarly, any two or more functions can be conducted simultaneously, and/or any function can be conducted in a series of steps.

The invention claimed is:

1. A pivot connector, comprising:
a retention element;
a body element;
at least a first holding structure; and
at least a first retention structure,
the retention element comprising at least a first body element interface structure,
the first body element interface structure comprising at least a first pivot alignment structure,
the body element comprising at least a first retention element interface region and at least a second alignment region,
the first retention element interface region comprising at least a first pivot alignment structure-receiving region,
the first holding structure comprising at least a first lighting device engagement region and at least a first alignment region,
the body element held in place relative to the first holding structure,
the first retention structure extending through the first alignment region and through the second alignment region to hold the body element in place relative to the first holding structure.

2. A pivot connector as recited in claim 1, wherein:
the retention element comprises a second body element interface structure,
the second body element interface structure comprises a second pivot alignment structure,
the body element comprises a second retention element interface region,
the second retention element interface region comprises a second pivot alignment structure-receiving region,
at least a first part of the second pivot alignment structure is radially substantially symmetrical, over at least a first angular range, with respect to an axis of the first part of the second pivot alignment structure, and
the first part of the second pivot alignment structure is in the second pivot alignment structure-receiving region.

3. A pivot connector as recited in claim 1, wherein:
the retention element comprises a second body element interface structure,
the second body element interface structure comprises a second pivot alignment structure,
the body element comprises a second retention element interface region,
the second retention element interface region comprises a second pivot alignment structure-receiving region,
at least a first part of the second pivot alignment structure-receiving region is radially substantially symmetrical, over at least a first angular range, with respect to an axis of the first part of the second pivot alignment structure-receiving region, and
the first part of the second pivot alignment structure is in the second pivot alignment structure-receiving region.

4. A pivot connector as recited in claim 1, wherein:
the retention element further comprises a substantially spherical region,
the body element further comprises a substantially spherical region-receiving structure, and
the substantially spherical region of the retention element is in the substantially spherical region-receiving structure of the body element.

5. A pivot connector as recited in claim 1, wherein:
the retention element comprises a second body element interface structure,
the second body element interface structure comprises a second pivot alignment structure,
the body element comprises a second retention element interface region,
the second retention element interface region comprises a second pivot alignment structure-receiving region,
at least a first part of the second pivot alignment structure is radially substantially symmetrical, over at least a first angular range, with respect to an axis of the first portion of the first pivot alignment structure,
the first part of the second pivot alignment structure is in the second pivot alignment structure-receiving region,
the retention element further comprises a substantially spherical region,
the body element further comprises a substantially spherical region-receiving structure,
the substantially spherical region of the retention element is in the substantially spherical region-receiving structure of the body element, and
the axis of the first portion of the first pivot alignment structure passes through a center of a sphere defined by the substantially spherical region of the retention element.

6. A pivot connector as recited in claim 1, wherein:
the retention element comprises a second body element interface structure,
the second body element interface structure comprises a second pivot alignment structure,
the body element comprises a second retention element interface region,
the second retention element interface region comprises a second pivot alignment structure-receiving region,
at least a first part of the second pivot alignment structure-receiving region is radially substantially symmetrical, over at least a first angular range, with respect to an axis of the first portion of the first pivot alignment structure-receiving region,
the first part of the second pivot alignment structure is in the second pivot alignment structure-receiving region,
the retention element further comprises a substantially spherical region,
the body element further comprises a substantially spherical region-receiving structure,
the substantially spherical region of the retention element is in the substantially spherical region-receiving structure of the body element, and
the axis of the first portion of the first pivot alignment structure passes through a center of a sphere defined by the substantially spherical region of the retention element.

7. A pivot connector as recited in claim 1, wherein:
the body element comprises at least a first body structure and a second body structure.

8. A pivot connector as recited in claim 1, wherein the retention element can be rotated at least 90 degrees relative to an axis that extends through the first pivot alignment structure.

9. A pivot connector as recited in claim 1, wherein the first holding structure comprises at least a first keying structure.

10. A pivot connector as recited in claim 1, wherein at least a portion of the body element is held inside an internal space defined by the first holding structure.

11. A pivot connector as recited in claim 7, wherein:

at least a first portion of the first pivot alignment structure is radially substantially symmetrical, over at least a first angular range, with respect to an axis of the first portion of the first pivot alignment structure, and the first portion of the first pivot alignment structure is in the first pivot alignment structure-receiving region.

12. A pivot connector as recited in claim 11, wherein:

the retention element can be rotated at least 90 degrees about the axis of the first portion of the first pivot alignment structure.

13. A pivot connector as recited in claim 1, wherein:

at least a first portion of the first pivot alignment structure-receiving region is radially substantially symmetrical, over at least a first angular range, with respect to an axis of the first portion of the first pivot alignment structure-receiving region, and the first portion of the first pivot alignment structure is in the first pivot alignment structure-receiving region.

14. A pivot connector as recited in claim 13, wherein:

the retention element can be rotated at least 90 degrees about the axis of the first portion of the first pivot alignment structure.

15. A power input assembly comprising:

a pivot connector as recited in claim 1;

a first electrical connector region; and at least a first electrical conductor, the first electrical conductor extending through an internal space defined by the retention element, the first electrical conductor electrically connected to the first electrical connector region.

16. An electrical connector apparatus comprising:

a power input assembly as recited in claim 15;

at least a second electrical connector region; and at least a first power input assembly engagement region.

17. An electrical connector apparatus as recited in claim 16, wherein:

the electrical connector apparatus further comprises at least a first keying region, the first keying region and the first power input assembly engagement region are held in place relative to each other, the first holding structure comprises at least a first keying structure, and the first keying region is removably engageable with the first keying structure.

18. An electrical connector apparatus as recited in claim 16, wherein:

the first power input assembly engagement region comprises at least a first spring element, and the first lighting device engagement region comprises at least a first spring element-receiving region.

19. An electrical connector apparatus as recited in claim 16, wherein:

the first lighting device engagement region comprises at least a first spring element, and the first power input assembly engagement region comprises at least a first spring element-receiving region.

20. An electrical connector apparatus as recited in claim 16, wherein:

the electrical connector apparatus further comprises at least a first light emitter.

21. A method comprising:

pivoting a retention element relative to a body element and a holding structure, the retention element comprising at least a first body element interface structure, the first body element interface structure comprising at least a first pivot alignment structure, the body element comprising at least a first retention element interface region, the first retention element interface region comprising at least a first pivot alignment structure-receiving region, the holding structure comprising at least a first lighting device engagement region, the body element held in place relative to the holding structure, at least a portion of the body element in the holding structure, and

[1] at least a first portion of the first pivot alignment structure radially substantially symmetrical, over at least a first angular range, with respect to an axis of the first portion of the first pivot alignment structure, said pivoting comprising pivoting the first portion of the first pivot alignment structure about said axis of the first portion of the first pivot alignment structure, the first portion of the first pivot alignment structure in the first pivot alignment structure-receiving region, or

[2] at least a first portion of the first pivot alignment structure-receiving region radially substantially symmetrical over at least a first angular range, with respect to an axis of the first portion of the first pivot alignment structure-receiving region, said pivoting comprising pivoting the first portion of the first pivot alignment structure about said axis of the first portion of the first pivot alignment structure-receiving region, the first portion of the first pivot alignment structure in the first pivot alignment structure-receiving region.

22. A method as recited in claim 21, wherein the retention element and the body element are in a pivot connector that comprises the retention element, the body element and the holding structure.

23. A method as recited in claim 21, wherein the retention element and the body element are in a power input assembly that comprises the retention element, the body element, a holding structure, at least one electrical conductor and at least a first electrical connector region.

24. A method as recited in claim 21, wherein:

the holding structure comprises at least a first alignment region, the body element comprises at least a second alignment region, and a first retention structure extends through the first alignment region and through the second alignment region to hold the body element in place relative to the holding structure.

25. A method as recited in claim 21, wherein:

the body element comprises at least a first body structure and a second body structure, and at least a portion of a first electrical connector region is between (1) at least a portion of the first body structure and (2) at least a portion of the second body structure.

26. A method as recited in claim 21, wherein the holding structure has an opening for receiving an electrical connector region of a lighting device.

27. A method as recited in claim 21, wherein:

the method further comprises providing an electrical connector apparatus, the electrical connector apparatus comprising a power input assembly, at least a first power input assembly engagement region, and at least a first keying region, the first keying region and the first power input assembly engagement region held in place relative to each other, the first holding structure comprising at least a first keying structure, and the first keying region removably engageable with the first keying structure.

28. A method as recited in claim 21, wherein:

the method further comprises providing an electrical connector apparatus, at least one of the first power input assembly engagement region and the first lighting device engagement region comprises at least a first spring element, and the other of the first lighting device engagement region and the first power input assembly engagement region comprises at least a first spring element-receiving region.

29. A method comprising:

pivoting a retention element relative to a body element and a holding structure, the retention element comprising at least a first body element interface structure, the first body element interface structure comprising at least a first pivot alignment structure, the body element comprising at least a first retention element interface region, the first retention element interface region comprising at least a first pivot alignment structure-receiving region, the holding structure comprising at least a first lighting device engagement region, the body element held in place relative to the holding structure, at least a portion of the body element in the holding structure, the retention element and the body element in an electrical connector apparatus that comprises the retention element, the body element, the holding structure, at least one electrical conductor, at least a first electrical connector region and a lighting device, the lighting device comprising a second electrical connector region and at least a first power input assembly engagement region, the holding structure comprising at least a first lighting device engagement region that is releasably engaged with the first power input assembly engagement region, and the first electrical connector region is releasably engaged with the second electrical connector region.

30. A power input assembly comprising:

a pivot connector;

a first electrical connector region; and at least a first electrical conductor, the pivot connector comprising:

a retention element;

a body element; and at least a first holding structure, the retention element comprising at least a first body element interface structure, the first body element interface structure comprising at least a first pivot alignment structure, the body element comprising at least a first retention element interface region and at least a first body structure and a second body structure, the first retention element interface region comprising at least a first pivot alignment structure-receiving region, the first holding structure comprising at least a first lighting device engagement region, the body element held in place relative to the first holding structure, the first electrical conductor extending through an internal space defined by the retention element, the first electrical conductor electrically connected to the first electrical connector region, at least a portion of the first electrical connector region between (1) at least a portion of the first body structure and (2) at least a portion of the second body structure.

31. An electrical connector apparatus comprising:

at least a first electrical connector region and a second electrical connector region;

at least a first power input assembly engagement region;

a power input assembly; and at least a first keying region, the power input assembly comprising:

a pivot connector;

the first electrical connector region; and at least a first electrical conductor, the pivot connector comprising:

a retention element;

a body element; and at least a first holding structure, the retention element comprising at least a first body element interface structure, the first body element interface structure comprising at least a first pivot alignment structure, the body element comprising at least a first retention element interface region, the first retention element interface region comprising at least a first pivot alignment structure-receiving region, the first holding structure comprising at least a first lighting device engagement region and at least a first keying structure, the body element held in place relative to the first holding structure, the first electrical conductor extending through an internal space defined by the retention element, the first electrical conductor electrically connected to the first electrical connector region, the first keying region and the first power input assembly engagement region held in place relative to each other, the first keying region removably engageable with the first keying structure.

32. An electrical connector apparatus comprising:

at least a first electrical connector region and a second electrical connector region;

at least a first power input assembly engagement region; and a power input assembly;

the power input assembly comprising:

a pivot connector;

the first electrical connector region; and at least a first electrical conductor, the pivot connector comprising:

a retention element;

a body element; and at least a first holding structure, the retention element comprising at least a first body element interface structure, the first body element interface structure comprising at least a first pivot alignment structure, the body element comprising at least a first retention element interface region, the first retention element interface region comprising at least a first pivot alignment structure-receiving region, the first holding structure comprising at least a first lighting device engagement region, the body element held in place relative to the first holding structure, the first electrical conductor extending through an internal space defined by the retention element, the first electrical conductor electrically connected to the first electrical connector region, one of the first power input assembly engagement region and the first lighting device engagement region comprising at least a first spring element, the other one of the first power input assembly engagement region and the first lighting device engagement region comprising at least a first spring element-receiving region.

* * * * *

UNITED STATES PATENT AND TRADEMARK OFFICE

CERTIFICATE OF CORRECTION

PATENT NO. : 9,325,134 B2
APPLICATION NO. : 13/621475
DATED : April 26, 2016
INVENTOR(S) : Peter E. Lopez et al.

It is certified that error appears in the above-identified patent and that said Letters Patent is hereby corrected as shown below:

In the Claims

Col. 22, Lines 27-29, Claim 21

Please change: "[2] at least a first portion of the first pivot alignment structure-receiving region radially substantially symmetrical over at least a first angular range, with respect to an axis" to -- [2] at least a first portion of the first pivot alignment structure-receiving region radially substantially symmetrical, over at least a first angular range, with respect to an axis --

Signed and Sealed this
Twenty-first Day of June, 2016

Michelle K. Lee

Michelle K. Lee
*Director of the United States Patent and Trademark Office*